United States Patent [19]

Maringer

[11] 4,124,664

[45] Nov. 7, 1978

[54] FORMATION OF FILAMENTS DIRECTLY FROM AN UNCONFINED SOURCE OF MOLTEN MATERIAL

[75] Inventor: Robert E. Maringer, Worthington, Ohio

[73] Assignee: Battelle Development Corporation, Columbus, Ohio

[21] Appl. No.: 746,096

[22] Filed: Nov. 30, 1976

[51] Int. Cl.[2] ..... B01J 2/02

[52] U.S. Cl. ..... 264/8; 264/164; 264/165; 164/87

[58] Field of Search ..... 264/237, 164, 165, 8; 164/87, 237

[56] References Cited

U.S. PATENT DOCUMENTS

| | | | |
|---|---|---|---|
| 2,825,108 | 3/1958 | Pond | 264/8 |
| 3,838,185 | 9/1971 | Maringer et al. | 264/8 |
| 3,843,762 | 10/1974 | Sleigh | 164/87 |
| 3,861,450 | 1/1975 | Mobley et al. | 164/87 |
| 3,863,700 | 2/1975 | Bedell et al. | 164/87 |
| 3,881,540 | 5/1975 | Kavesh | 264/237 |
| 3,881,542 | 5/1975 | Polk et al. | 164/87 |
| 3,896,203 | 7/1975 | Maringer et al. | 264/165 |
| 3,904,344 | 9/1975 | Maringer et al. | 164/87 |

OTHER PUBLICATIONS

"Method of Producing Rapidly Solidified Filamentors Castings" by Pond et al., Trans. of Metal Soc. of AIME, vol. 245, pp. 2475, 2476, Nov. 1969.

*Primary Examiner*—Jay H. Woo
*Attorney, Agent, or Firm*—Thomas W. Winland

[57] ABSTRACT

The invention comprises methods and apparatus for forming filamentary material directly from a pendant drop of molten material, and provides for a significant improvement in the quench rate. A typical method of making filamentary material according to the invention, comprises the steps of: (a) heating a solid material, typically, a metal or metal alloy, so as to form a pendant molten drop of the material which is at a temperature within 25 percent of its equilibrium melting point in °K, said molten material having a surface tension of 10 to 2500 dynes/cm. and a viscosity of 0.001 to 1.0 poise at said temperature; (b) rotating a hollow cylindrical member about its longitudinal axis at a peripheral speed in excess of 3 feet per second, said member having a circumferential, heat-extracting lip projecting from its inner periphery, and said lip having a narrow peripheral edge of arcute cross section; and, (c) bringing the surface of said pendant molten material drop and said peripheral edge of the lip into contact so as to withdraw a solidifying filament from the drop while maintaining the form and stability of the drop. Typically, said lip is located at one end of said cylindrical member. The heat-extracting lip may typically be substantially V-shaped, with the apical region of the V-shape comprising said narrow peripheral edge of the lip; and typically, said edge may possess at least one indentation disposed to attenuate said filamentary material into discontinuous fiber.

14 Claims, 6 Drawing Figures

FORMATION OF FILAMENTS DIRECTLY FROM AN UNCONFINED SOURCE OF MOLTEN MATERIAL

The invention herein described was made in the course of or under a contract or subcontract thereunder, with the Department of the Air Force.

BACKGROUND OF THE INVENTION

The present invention relates to the art of making filamentary material by rotating a heat-extracting member in contact with a source of molten material and solidifying a portion of the molten material as a filamentary product on the surface of the rotating member from where it spontaneously releases and is subsequently collected.

The present invention is an improvement over the methods disclosed in U.S. Pat. No. 3,838,185 (Maringer, et al) and U.S. Pat. No. 3,896,203 (Maringer, et al), both assigned to common assignee, Battelle Development Corporation, and said patents are incorporated herein by reference to the extent necessary for a full and complete understanding of the present invention.

The prior art is replete with methods and apparatus disposed to produce filamentary material directly from a source of molten material. Many prior art methods are limited to metal products and most use some type of forming orifice to control the size of the filament. Typical of such teachings is U.S. Pat. No. 2,825,108, Pond, where the molten material (a metal) is formed into a filamentary form by forcing it through an orifice so as to form a free standing stream of molten material which is subsequently solidified into filamentary form on a rotating heat-extracting member. The rate of production is determined by the rate at which the molten material is expelled from the orifice and for continuous filament this rate must be at least roughly synchronous with the rate of movement of the heat-extracting member at the point of impingement. Techniques of this type are troubled by the relative complexity of process control and the inherent difficulty in passing molten material through small orifices. The orifices must be of an exotic material if the molten material has a relatively high melting point and the orifices have a tendency to erode or clog. A successful solution to the problems arising with forming orifices is taught in U.S. Pat. No. 3,838,185, where a disk-like heat-extracting member forms the filamentary product by solidifying the product on the outer edge of the disk as it rotates in contact with the surface of a pool-like source of molten material. In this manner a filamentary product is formed without the use of a forming orifice. This teaching, however, is limited to the use of a pool-like source of molten material. Such a source of molten material necessitates the melting and holding of significant quantities of material. While the amount of heat needed to melt a given mass of a solid is the same regardless of its future disposition, the holding of quantities of molten material introduces several problems. The first is simply the energy required to maintain the molten material at high temperature. Second is the exposure of the molten material to the atmosphere. Without isolating the pool-like source of molten material from the atmosphere, it is difficult to maintain constant chemical compositions in the molten material due to oxidation at the surface of the melt or the loss of volatile materials from the melt.

A successful solution to these problems is taught by U.S. Pat. No. 3,896,203, where the source of molten material is a portion of molten material adherent in a drop-like form to a solid with its shape determined by the surface tension of the molten material. The circumferential edge of a rotary disk-like heat-extracting member is brought into contact with the molten material and a filamentary product is formed adherent to the rotating member. Ultimately, the filament spontaneously separates from the rotary member to be collected. This teaching, however, does not indicate any solution to problems of collection. Further, this teaching permits centrifugal force to assist in removing the casting from the surface of the rotating disk, thus shortening the time of contact and decreasing the amount of heat which can be transferred from the solidifying metal to the rotary disk.

The present invention utilizes centrifugal force to maintain contact of the cast filamentary product with the rotating disk thereby increasing the amount of heat transfer and increasing the quench rate.

A further advantage of the present invention is that the cast filament can be guided directly into a cylindrical cavity which is an integral part of the casting system, thus causing the cast filament to be collected with a minimum amount of disturbance to its natural trajectory.

The present invention finds significant utility in forming filamentary products for which very high quench rates are required, and in providing for the collection of those filaments in convenient coils.

SUMMARY OF THE INVENTION

The present invention comprises methods and apparatus for forming filamentary material directly from a pendant drop of molten material, and provides for a significant improvement in the process quench rate. A typical method of making filamentary material according to the present invention, comprises the steps of: (a) heating a solid material typically, although not necessarily, a metal or metal alloy, so as to form a pendant molten drop of the material which is at a temperature within 25 percent of its equilibrium melting point in ° K., said molten material having a surface tension of 10 to 2500 dynes/cm. and a viscosity of 0.001 to 1.0 poise at said temperature; (b) rotating a hollow cylindrical member about its longitudinal axis at a peripheral speed in excess of 3 feet per second, said member having a circumferential, heat-extracting lip projecting from its inner periphery, and said lip having a narrow peripheral edge of arcuate cross section; and, (c) bringing the surface of said pendant molten material drop and said peripheral edge of the heat-extracting lip into contact so as to withdraw a solidifying filament from the drop while maintaining the form and stability of the drop. Typically, said lip is located at one end of said cylindrical member and said drop is formed by melting one end of a rod of said material. The heat-extracting lip may typically be substantially V-shaped, with the apical region of the V-shape comprising said narrow peripheral edge of the lip, and with the radius of curvature of said arcuate edge being in the range from about 0.0005 inch to 0.10 inch and the filamentary material having an effective cross sectional area less than 0.003 square inches.

Said edge may possess at least one indentation disposed at attenuate said filamentary material into discontinuous fiber, with each fiber having a length approximating the distance along the edge between said indentations.

Subsequent to its release from said edge the filamentary material may be directed by a guide means into said hollow cylindrical member and away from said heat-extracting lip.

Typically the filamentary material is collected on a spindle extending into the hollow cylindrical member, with said spindle being either static or rotating.

In one typical embodiment of the invention the end of the hollow cylindrical member having no heat-extracting lip is enclosed, thereby forming a cup-like structure, and said member is rotated about a shaft attached to the outer periphery of said enclosed end and extending along the longitudinal axis of said member.

Another typical process according to the present invention comprises the steps of: (a) providing a pendant drop of molten material, typically a metal or metal alloy, protruding from an orifice, said material being at a temperature within 25 percent of its equilibrium melting point in ° K. and having a surface tension of 10 to 2500 dynes/cm. and a viscosity of 0.001 poise at said temperature and said drop having a shape determined by the surface tension of said molten material; (b) rotating a hollow cylindrical member about its longitudinal axis at a peripheral speed in excess of 3 feet per second, said member having a circumferential, heat-extracting lip protecting from its inner periphery, and said lip having a narrow peripheral edge of arcuate cross section; and, (c) bringing the surface of said pendant molten drop and said peripheral edge of the heat-extracting lip into contact so as to withdraw a solidifying filament from the drop while maintaining the form and stability of the drop.

A typical apparatus for making filamentary material according to the present invention comprises: (a) a hollow cylindrical member rotatable about its longitudinal axis, said member having a circumferential, heat-extracting lip projecting from its inner periphery, and said lip having a narrow peripheral edge of arcuate cross section; (b) means for rotating said cylindrical member about its longitudinal axis at a peripheral speed in excess of 3 feet per second; (c) a solid member of said material; (d) means for heating the solid member so as to form a pendant molten drop of the material which is at a temperature within 25 percent of its equilibrium melting point in ° K., said molten material having a surface tension of 10 to 2500 dynes/cm. and a viscosity of 0.001 to 1.0 poise at said temperature; and (e) means for bringing the surface of said pendant molten drop and said peripheral edge of the heat-extracting lip into contact so that, in operation, the rotating peripheral edge contacts the drop so as to withdraw a solidifying filament from the drop while maintaining the form and stability of the drop. Typically said heat-extracting lip is substantially V-shaped, with the apical region of the V-shape comprising said narrow peripheral edge.

In another typical embodiment said edge of the heat-extracting lip possesses at least one indentation disposed to attenuate said filamentary material into discontinuous fiber, with each fiber having a length approximating the distance along the edge between said indentations.

The apparatus of the present invention may include guide means disposed adjacent to said edge for directing the filamentary material into said hollow cylindrical member and away from said heat-extracting lip subsequent to its release from said edge, and may also include spindle means extending into said hollow cylindrical member and disposed to collect the filamentary material.

Typically said lip is located on one end of said cylindrical member, and the end of the hollow cylindrical member having no heat-extracting lip is enclosed, thereby forming a cup-like structure, and typically said means for rotating said cylindrical member may comprise a shaft attached to the outer periphery of said enclosed end and extending along the longitudinal axis of said cylindrical member.

Another typical apparatus may comprise: (a) a hollow cylindrical member rotatable about its longitudinal axis, said member having a circumferential, heat-extracting lip projecting from its inner periphery, and said lip having a narrow peripheral edge of arcuate cross section, (b) means for rotating said cylindrical member about its longitudinal axis at a peripheral speed in excess of 3 feet per second; (c) means for providing a pendant drop of molten material protruding from an orifice, said molten material being at a temperature within 25 percent of its equilibrium melting point in ° K. and having a surface tension of 10 to 2500 dynes/cm. and a viscosity of 0.001 to 1.0 poise at said temperature, and said drop having a shape determined by said surface tension; and (d) means for bringing the surface of said drop and said peripheral edge of the heat-extracting lip into contact so as to withdraw a solidifying filament from the drop while maintaining the form and stability of the drop.

BRIEF DESCRIPTION OF THE DRAWINGS

FIG. 4 also shows typical means for collecting the filament in such an embodiment.

DETAILED DESCRIPTION OF THE INVENTION

Figure 1:
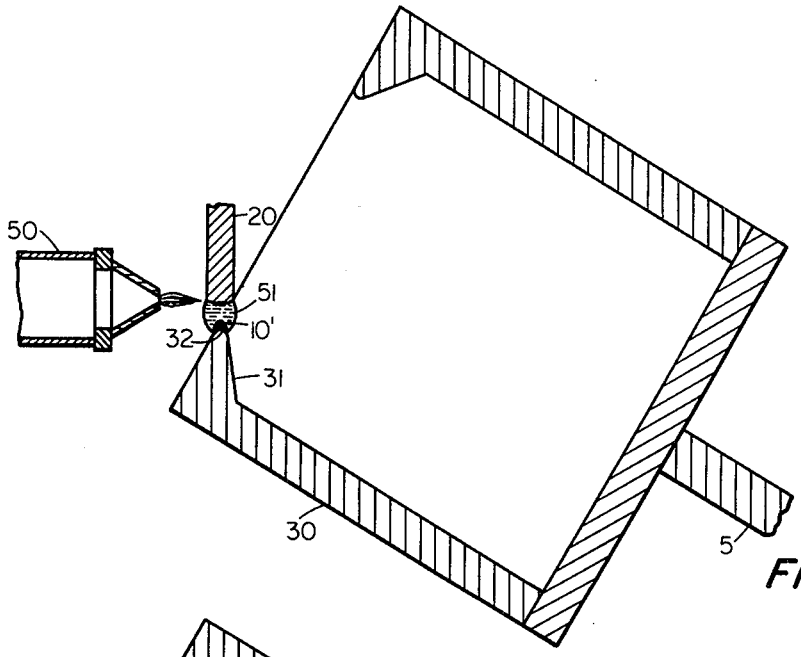
FIG. 1 is a view in partial cross section of a typical embodiment of the invention suitable for forming continuous filament from a drop of molten material pendant from a solid rod-like source of the material.

One preferred embodiment of the present invention is illustrated in FIG. 1. Cylinder 30, having its lower end enclosed, is shown rotating about its longitudinal axis, with the cylinder being driven by shaft 5 connected as shown. Shaft 5 may be driven by any conventional driving means (not shown).

A lip 31 projects inwardly from the inner periphery of the cylinder at its open, upper end. In this embodiment the lip is roughly V-shaped in cross section, with the apical region of the V-shape comprising a narrow peripheral edge 32 of a arcuate cross section. For the production of continuous filamentary material according to this embodiment it is preferred that the lip extend only a relatively short distance (on the order of a few tenths of an inch) from the inner periphery of the cylinder.

The member 20, which constitutes the material supply for this embodiment of the process, may be of any convenient shape, such as, for example, rod 20. As shown, the end portion of member 20 may be melted by any conventional means, such as for example, oxy-acetylene torch 50. The local heating of the end portion of the member 20 creates a molten zone 51.

For purposes of definition the unconfined molten material adherent to the solid member will be termed a pendant drop irrespective of the geometric configuration of the drop to the solid member or the force of gravity.

The process of the present invention is initiated by bringing the rotating edge 32 and the pendant drop 51 into contact. Surprisingly the surface tension of the material in the drop 51 is sufficient to maintain stability even with the edge 32 entering and inducing a shear flow within the drop.

As discussed above, while the term pendant drop is used throughout the specification, and while the term is clearly applicable for the embodiments shown in the figures, it is to be understood that the present invention is also operable with what is termed as sessible drop. That is, looking at FIG. 1, if the location of the drop were 180° from its indicated location (i.e. if member 20 were inverted and drop 51 contacted edge 32 at its upper extremity) the drop would properly be called a sessile drop. The present invention is operable in both configurations and the term pendant drop, as used in this specification, is intended to cover both configurations.

By unconfined it is meant that the drop is not restrained by any member disposed to oppose the shear forces generated by the edge passing through the drop. The drop may be supported against the effect of gravity by the presence of the solid member from which the drop is formed or the presence of an orifice may support the drop, but no attempt is made to restrain the drop from the motion induced by the forming edge. When the edge 32 passes through the pendant drop 51, a portion 10' of the molten material solidifies on the edge 32. Further rotation of the cylinder 30 draws this (solidified) filamentary portion 10' out of the pendant drop 51. The filament 10' tends to adhere tightly to the edge 32 for a short distance (several centimeters or less), and then it spontaneously ruptures this bond (apparently due to thermal shrinkage) and finally becomes a collectable solid filamentary material. It is to be noted that contrary to the processes of U.S. Pat. Nos. 3,838,185 and 3,896,203, in the present invention centrifugal force acts to increase the period of time during which the filament 10' is in contact with edge 32. This new and different aspect greatly enhances heat transfer from the filament 10' to the edge 32, thereby significantly increasing the quench rate.

Figure 2:
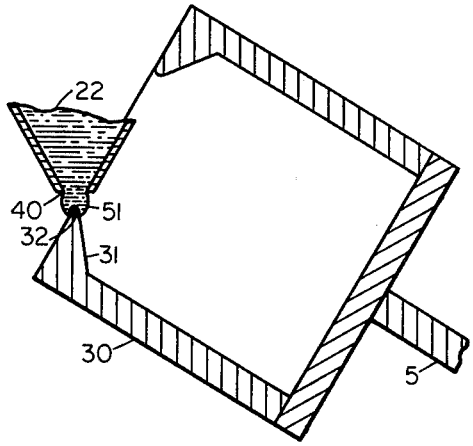
FIG. 2 is a view in partial cross section of an embodiment in which the pendant drop comprises a drop of molten material pendant from an orifice which leads from a supply of the molten material.

FIG. 2 shows the present invention in a different emodiment where the pendant drop 51 is not produced by the local heating of a solid but is instead produced by forming a pendant drop adherent to an orifice 40 leading to a supply of molten material 22. The pendant drop need not be spherical in cross section.

In the embodiment of FIG. 2 the means used to create the molten metal supply may be of any conventional type. Some means of heating the material at the orifice may be needed if the configuration of the molten supply is such that the orifice is at a significantly lower operating temperature than the remainder of the molten metal supply.

Figure 3:
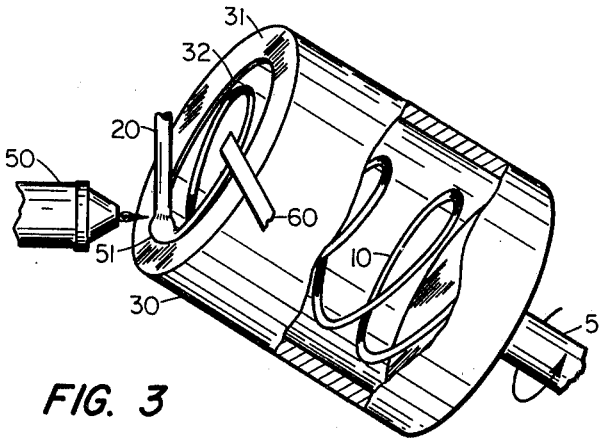
FIG. 3 is an isometric view showing the collection of the freshly cast filament within the cylindrical cup-like member, and showing the use of a guide means to direct the filament into the cylindrical member.

FIG. 3 illustrates the use of an optional guide member 60 to direct freshly cast filament 10 into the enclosed portion of the cylinder. While this method of filament collection is a preferred method, it should be noted that it is not essential that the filament enter the enclosed portion of the cylinder, since it is possible to collect the filament outside of the cylinder. While for certain cylinder orientations centrifugal force and the force of gravity may be sufficient to cause the freshly cast filament to move into the lower portion of the cylinder, the use of a guide member or some auxiliary force is generally preferred. An example of an auxiliary force would be the air current created during rotation of the cylinder if holes are drilled through the enclosed end of the cylinder. FIG. 3 also illustrates a typical manner in which the filament may be collected in this embodiment.

Figure 4:
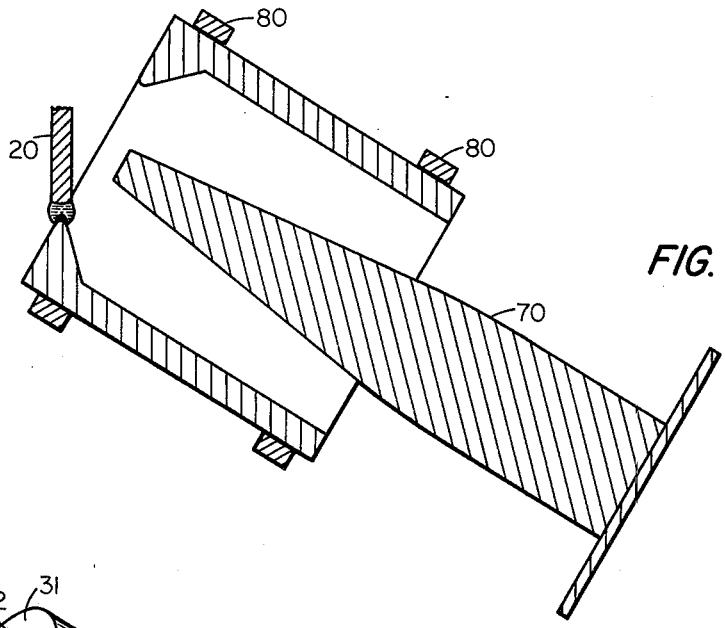
FIG. 4 is a view in partial cross section of a typical embodiment of the invention wherein the lower end of the cylindrical member is open, so that the filament may exit freely.

In the embodiment shown in FIG. 4 the cylinder is open at its lower end, permitting the filament to exit the cylinder freely. The filament may then be collected on any conventional collection device, such as, for example, spindle 70. The collection device may be static or it may rotate in the direction of the cylinder. This embodiment permits collection and retrieval of the filament with great ease. In this embodiment the cylinder may be rotated by any conventional drive means, such as, for example, drive rollers 80.

Figure 5:
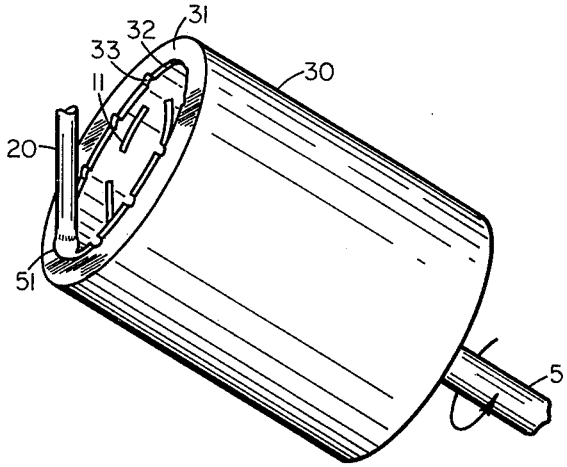
FIG. 5 is an isometric view of a typical embodiment of the invention suitable for forming controlled length, discontinuous filament.

The present invention can produce both continuous and discontinuous filament. FIG. 5 illustrates an embodiment disposed to produce discontinuous fiber of controlled length. The edge of the rotating cylinder lip is indented at the interval desired to be the filament length. The shape of the indentations is not known to be critical and a semi-circular indentation of a depth greater than the thickness of the filament will produce controlled length discontinuous filament.

FIG. 5 illustrates a rotating cylinder lip 31 having, in this embodiment, semi-circular indentations 33 on the edge 32 of the lip. The indentations 33 on the edge attenuate the filament 10 into discrete fibers 11 approximately equal in length to the distance between the indentations. Suprisingly the passage of the edge 32 containing indentations therein through an unconfined drop 51 of molten material does not materially disturb the stability of the drop. For most embodiments of the invention utilizing the indented rotating lip, the edge 32 appears to protrude into the drop a distance of less than 10 mils. The use of high rotational speeds for the rotating cylinder (and hence high linear velocities at the edge 32) are preferred for this embodiment.

Within the operable range of heat input to the source material, the size of the filamentary product may be controlled by the amount of molten material available to the edge of the rotating cylinder lip. By limiting the volume of the molten source material and rotating the cylinder at high rates of speed, filamentary products of very small cross section can be produced. Since the cross section of the filamentary product is normally non-circular, the size of the filament is defined in terms of its effective diameter. The effective diameter of a filament having an irregular cross section is equal to the diameter of a filament having a circular cross section and equal in cross-sectional area to the cross section of the non-circular filament. The present invention should be capable of producing filament having an effective diameter in the range of from 0.0004 to 0.030 inch.

While the present invention is useful in forming metal filaments, fiber, or wire, the invention is not limited solely to metals. The present invention should be operable with any material possessing properties, in the molten state at temperatures reasonably close to its melting point, similar to those of molten metals. The molten material should have, at a temperature within 25 percent of its equilibrium melting point in ° K., the following properties: a surface tension in the range of from 10 to 2,500 dynes/cm, a viscosity in the range of from $10^{-3}$ to 1 poise and a reasonably discrete melting point (i.e. a discontinuous temperature versus viscosity curve). The present invention is operable with most metals as well as chemical compounds, and elements meeting the above criteria. In addition, the present invention is operable with metal alloys even where such alloys display a wide temperature range between the first solidification of any component within the alloy (the liquidus temperature) and the temperature at which the lowest melting point compositions solidify (the solidus temperature) yielding a completely solid material. For purposes of definition, such an alloy would be "molten" only above the liquidus temperature even though there is some molten material present at a temperature between the liquidus and solidus temperatures.

Because of the limited exposure of the molten material to the surrounding atmosphere and the ease in providing local gas shielding of the pendant drop, the oxidation characteristics of many metals and alloys do not limit their operability with the present invention. Materials known to be operable without the need for complete oxidation protection include the metals consisting essentially of iron, aluminum, copper, nickel, tin, and zinc. Where it is desired to totally isolate the process from the surrounding atmosphere, the entire apparatus may be confined within a gas tight sealed closure. The process could then be carried out in a vacuum or in inert gas. If the source material has a significant vapor pressure, the composition and pressure of the gas within the enclosure could be manipulated so as to reduce evaporation from the molten material. Such an enclosure would also facilitate the use of local heating means that are inoperable in the atmosphere (e.g., electron beam heating). Metals operable with means to reduce oxidation include those consisting essentially of titanium, columbium, tantalum, zirconium, magnesium, and molybdenum.

The means used to locally heat the material so as to form an adherent pendant drop is not critical to the invention. There are numerous means available in the art to locally heat a member and one skilled in the art can arrive at an operable embodiment of the invention without the need for excessive experimentation. For example, an oxygen-acetylene torch may be used with many materials, and the use of an acetylene rich flame would have the advantage of providing a shielding atmosphere to the pendant drop to reduce oxidation of the molten material. Various heating means may be used including resistance heating, induction heating, electron beam heating, etc. The means used for local heating of a solid source would be determined by considering the melting point of the material to be melted, the mass of material to be molten at a given time and the rate at which the source material is to be heated to its melting point. If the heat supplied the source material is excessive, then the pendant drop may become to large to remain stable. If the heat is insufficient, then the rotating filament forming member will not have sufficient molten material to produce a filament of controlled dimension.

The shape of the filamentary material produced is dependent in part on the shape of the peripheral edge introduced to the melt surface. As discussed in U.S. Pat. Nos. 3,838,185 and 3,896,203, it is important that the peripheral edge be of arcuate cross section and be narrow in relation to the width of the pendant drop.

FIGS. 1–5 illustrate a preferred cylinder lip configuration wherein the cylinder lip is substantially V-shaped in cross section (i.e. tapered), with the apical region of the V-shape comprising the arcuate peripheral edge which contacts the melt. In this embodiment the radius of curvature of the peripheral edge (i.e. the apical region of the V-shape) is typically in the range of from about 0.0005 to 0.10 inch, and the angle between the legs of the V-shape typically is in the range of about 60° to 120°. Such an embodiment will typically produce filament having a cross-sectional area of less than 0.003 $inch^2$.

Figure 6:
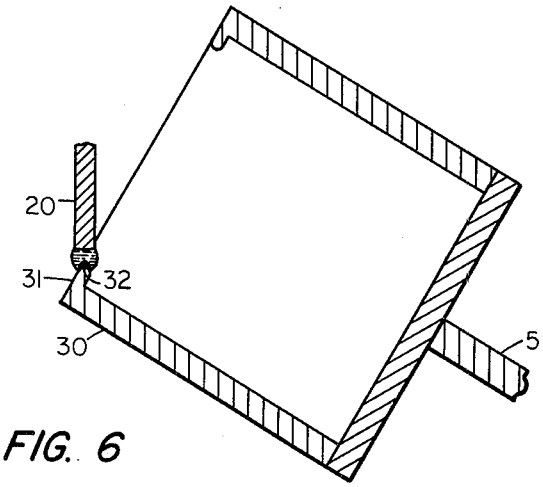
FIG. 6 is a view in partial cross section showing an alternative heat-extracting lip configuration.

FIG. 6 shows an alternative lip configuration. In this embodiment the radius of curvature of the peripheral edge should also be less than 0.10 inch.

A dimensionally inferior product will result from rotating an edge in contact with the pendant drop without limiting the area in contact with the molten material. Such a process would not produce a dimensionally consistent product as does the present invention since such a surface generates larger shear forces within the pendant drop that degrade its stability. To produce dimensionally consistent filamentary material the pendant drop should be as stable as possible during the process. The stability of the pendant drop as utilized in the present invention is due to the fact the edge passed through the pendant drop is narrow in relation to the width of the drop. This minimizes the disturbance of the drop's surface which, through surface tension, is responsible for the stability of the drop form.

The diameter of the cylinder lip is not critical to the present invention. However, a preferred embodiment would have a lip diameter in the range of from 3 to 30 inches. While the lip need not be of any special material, it must have the capacity to remove heat from the molten material at a rate so as to solidify the material in the form of a filament on the peripheral edge. The lip, which may properly be termed a heat-extracting lip, should have either a high intrinsic heat capacity or have good thermal conductivity so as to extract heat from the molten material. Even materials not having either a high heat capacity or thermal conductivity can be used if they are subjected to some means of internal cooling analogous to that shown in FIG. 5 of U.S. Pat. No. 3,838,185. The present invention should be operable with a heat-extracting lip composed of the metals copper, aluminum, nickel, molybdenum, and iron. There is no indication a metal lip is needed and a nonmetal (as for example, graphite) may be used as the material for the heat-extracting lip. The lip may also be composed of several different materials so as to combine the properties of each to optimize performance.

The geometric configurations of the various elements of the embodiments shown in the figures are not the only operable configurations. However, with the pendant drop being unconfined, the force of gravity must always be considered. The shape of the pendant drop is determined by gravity, the surface tension of the molten material and the viscous drag induced by the contact of the rotating edge.

The ultimate size of the filamentary product is determined by the amount of molten material available at the peripheral edge of the heat-extracting lip, the shape of the edge introduced to the pendant drop, the viscosity of the molten material and the speed at which the edge is passed through the pendant drop. The invention should be operable where the linear velocity of the lip is in the range of from 3 to 100 feet per second. The upper limit does not appear to be a limitation of the invention but merely the effect equipment limitations made apparent by the high rotational speeds required.

EXAMPLE 1

A drop of molten tin was formed on the end of a solid bar of tin by locally heating the end with a propane torch. The drop was manually brought into contact with the peripheral edge of a V-shaped, heat-extracting lip of a rotating hollow aluminum cylinder similar to that shown in FIG. 1. The axis of rotation of the cylinder was at an angle of approximately 25° from the horizontal, and the diameter of the circle circumscribed by the peripheral edge of the lip was approximately 4.7 inches. The angle described by the two sides of the V-shaped lip was about 45° and the radius of curvature of the peripheral edge of the lip was about 0.002 inch. The cylinder was rotated so as to yield a linear velocity at the peripheral edge of the lip of approximately 5 feet per second. Tin filament was formed which spontaneously released from the forming edge. Use of a flat piece of shim stock manually held adjacent to the cylinder lip as a guide means, as shown in FIG. 3, about 3 inches beyond the point where the drop contacted the lip insured that the filament was collected inside the cylinder. However, by appropriate positioning of the guide means, the filament could also be directed to fall outside of the cylinder.

Although the present invention has been described in connection with certain specific embodiments, such description is meant to be illustrative only and not restrictive or limiting, and it is to be understood that various changes and modifications may be resorted to by those skilled in the art without departing from the spirit and scope of the invention.

I claim:

1. A method of making filamentary material, comprising the steps of:

(a) heating a solid material so as to form a pendant molten drop of the material which is at a temperature within 25 percent of its equilibrium melting point in ° K, said molten material having a surface tension of 10 to 2500 dynes/cm. and a viscosity of 0.001 to 1.0 poise at said temperature;

(b) rotating a hollow cylindrical member about its longitudinal axis at a peripheral speed in excess of 3 feet per second, said member having a circumferential, heat-extracting lip projecting from its inner periphery, and said lip having a narrow peripheral edge of arcuate cross section; and, (c) bringing the surface of said pendant molten drop and said peripheral edge of the heat-extracting lip into contact so as to spontaneously withdraw a solidifying filament from the drop while maintaining the form and stability of the drop.

2. The method of claim 1, wherein said lip is located at one end of said cylindrical member.

3. The method of claim 1, wherein said drop is formed by melting one end of a rod of solid material.

4. The method of claim 1, wherein said heat-extracting lip is substantially V-shaped, with the apical region of the V-shape comprising said narrow peripheral edge of the lip.

5. The method of claim 4, wherein the radius of curvature of said arcuate edge is in the range from about 0.0005 inch to 0.10 inch and the filamentary material has an effective cross sectional area less than 0.003 square inches.

6. The method of claim 1, wherein said edge possesses at least one indentation disposed to attenuate said filamentary material into discontinuous fiber, with each fiber having a length approximating the distance along the edge between said indentations.

7. The method of claim 2, wherein subsequent to its release from said edge the filamentary material is directed by a guide means into said hollow cylindrical member and away from said heat-extracting lip.

8. The method of claim 2, wherein the filamentary material is collected on a spindle extending into the hollow cylindrical member.

9. The method of claim 8, wherein said spindle is rotating.

10. The method of claim 2, wherein the end of the hollow cylindrical member having no heat-extracting lip is enclosed, thereby forming a cup-like structure, and said member is rotated about a shaft attached to the outer periphery of said enclosed end and extending along the longitudinal axis of said member.

11. The method of claim 1, wherein said solid material is a metal or metal alloy.

12. A method of making filamentary material comprising the steps of:

(a) providing a pendant drop of molten material protruding from an orifice, said material being at a temperature within 25 percent of its equilibrium melting point in ° K and having a surface tension of 10 to 2500 dynes/cm and a viscosity of 0.001 poise at said temperature and said drop having a shape determined by the surface tension of said molten material;

(b) rotating a hollow cylindrical member about its longitudinal axis at a peripheral speed in excess of 3 feet per second, said member having a circumferential, heat-extracting lip projecting from its inner periphery, and said lip having a narrow peripheral edge of arcuate cross section; and, (c) bringing the surface of said pendant molten drop and said peripheral edge of the heat-extracting lip into contact so as to spontaneously withdraw a solidifying filament from the drop while maintaining the form and stability of the drop.

13. The method of claim 12, wherein said molten material is a metal or metal alloy.

14. The method of claim 12, wherein said edge possesses at least one indentation disposed to attenuate said filamentary material into discontinuous fiber, with each fiber having a length approximating the distance along the edge between said indentations.

* * * * *